US011374312B2

(12) United States Patent
Chen et al.

(10) Patent No.: US 11,374,312 B2
(45) Date of Patent: Jun. 28, 2022

(54) ANTENNA DEVICE AND TERMINAL

(71) Applicant: JRD COMMUNICATION (SHENZHEN) LTD., Shenzhen (CN)

(72) Inventors: Lei Chen, Shenzhen (CN); Liyun Liu, Shenzhen (CN)

(73) Assignee: JRD COMMUNICATION (SHENZHEN) LTD., Shenzhen (CN)

( * ) Notice: Subject to any disclaimer, the term of this patent is extended or adjusted under 35 U.S.C. 154(b) by 7 days.

(21) Appl. No.: 16/910,064

(22) Filed: Jun. 24, 2020

(65) Prior Publication Data

US 2020/0321696 A1 Oct. 8, 2020

Related U.S. Application Data

(63) Continuation of application No. PCT/CN2018/122878, filed on Dec. 21, 2018.

(30) Foreign Application Priority Data

Dec. 25, 2017 (CN) ..... 201711442262.3

(51) Int. Cl.

| | |
|---|---|
| ***H01Q 1/22*** | (2006.01) |
| ***H01Q 1/50*** | (2006.01) |
| ***H01Q 1/36*** | (2006.01) |
| ***H01Q 1/48*** | (2006.01) |

(52) U.S. Cl.

CPC ..... *H01Q 1/50* (2013.01); *H01Q 1/22* (2013.01); *H01Q 1/36* (2013.01); *H01Q 1/48* (2013.01)

(58) Field of Classification Search

CPC ..... H01Q 1/22–1/27; H01Q 1/36–1/48; H01Q 5/30; H01Q 5/20–30

See application file for complete search history.

(56) References Cited

U.S. PATENT DOCUMENTS

| | | | | |
|---|---|---|---|---|
| 9,281,565 | B2 * | 3/2016 | Chiu | H01Q 1/2266 |
| 9,634,385 | B2 * | 4/2017 | Feng | H01Q 1/38 |
| 2017/0170545 | A1 | 6/2017 | Merli et al. | |

(Continued)

FOREIGN PATENT DOCUMENTS

| | | | |
|---|---|---|---|
| CN | 101278438 | A | 10/2008 |
| CN | 201498596 | U | 6/2010 |
| CN | 101998689 | A | 3/2011 |

(Continued)

OTHER PUBLICATIONS

International search report,PCT/CN2018/122878, dated Mar. 21, 2019 (2 pages).

(Continued)

*Primary Examiner* — Hasan Z Islam

(57) ABSTRACT

The present disclosure discloses an antenna device and a terminal. The antenna device includes a first branch, a second branch, a third branch, a public branch, and a feed point. The first branch, the second branch, the third branch, a public branch and the feed point constitute a diversity antenna cooperatively. The first branch is configured as an earpiece metal mesh. The feed point is electrically connected to the first branch. The second branch and the third branch are electrically connected to an end of the public branch, respectively. An another end of the public branch is electrically connected to the feed point.

17 Claims, 3 Drawing Sheets

(56) References Cited

U.S. PATENT DOCUMENTS

2018/0376235 A1* 12/2018 Leabman ..... H04R 1/1025

FOREIGN PATENT DOCUMENTS

| | | | |
|---|---|---|---|
| CN | 203826538 | U | 9/2014 |
| CN | 104124534 | A | 10/2014 |
| CN | 104409850 | A | 3/2015 |
| CN | 104836023 | A | 8/2015 |
| CN | 104882664 | A | 9/2015 |
| CN | 108565542 | A | 9/2018 |
| KR | 1020090028356 | A | 3/2009 |

OTHER PUBLICATIONS

First Office Action from China patent office in a counterpart Chinese patent Application 201711442262.3, dated Sep. 10, 2019 (16 pages).
Second Office Action from China patent office in a counterpart Chinese patent Application 201711442262.3, dated May 13, 2020 (16 pages).

* cited by examiner

ANTENNA DEVICE AND TERMINAL

CROSS REFERENCE

The present application is a continuation-application of International (PCT) Patent Application No. PCT/CN2018/122878, filed on Dec. 21, 2018, which claims foreign priority of Chinese Patent Application No. 201711442262.3, filed on Dec. 25, 2017, in the National Intellectual Property Administration of China, the entire contents of which are hereby incorporated by reference in its entirety.

TECHNICAL FIELD

The present disclosure relates to the field of antenna technologies, and in particular to an antenna device and a terminal.

BACKGROUND

Metal accessories, such as earphones that include a metal mesh, arranged on terminals such as mobile phones and tablets may affect the performance of an antenna. The metal accessories may absorb the radiation power of the antenna while the antenna is working and reduce the radiation efficiency of the antenna.

An earpiece metal mesh in the terminal is closer to the antenna and is prone to affect the radiation performance of a diversity antenna in an antenna alignment area. Therefore, the presence of the earpiece metal mesh in the antenna alignment area is required not to affect the performance of the manifold antenna.

SUMMARY OF THE DISCLOSURE

A technical scheme according to the present disclosure is to provide an antenna device.

The antenna device may include: a first branch, being configured as an earpiece metal mesh and having an elliptical ring configuration; a feed point, being electrically connected to the first branch; a second branch, a third branch and a public branch.

In an embodiment, the second branch and the third branch are electrically connected to an end of the public branch, and an another end of the public branch is electrically connected to the feed point.

In an embodiment, the first branch, the second branch, the third branch and the public branch constitute a diversity antenna cooperatively.

In an embodiment, the diversity antenna is a monopole antenna and the diversity antenna resonates at a quarter wavelength.

The public branch may include a first resonant portion, a second resonant portion and a third resonant portion, the first resonant portion being connected to the feed point, the second resonant portion being connected to the first resonant portion, and the third resonant portion being connected to the second resonant portion and the second branch, respectively. A longitudinal direction of the first resonant portion is perpendicular to a long axis direction of the elliptical ring, the longitudinal direction of the second resonant portion is perpendicular to the longitudinal direction of the first resonant portion, and the longitudinal direction of the third resonant portion is perpendicular to the longitudinal direction of the second resonant portion.

The longitudinal direction of the second branch is perpendicular to the longitudinal direction of the third resonant portion.

The third branch may include a fourth resonant portion, a fifth resonant portion and a sixth resonant portion, the fourth resonant portion being formed by an extension of the second branch, the fifth resonant portion being connected to the fourth resonant portion, the sixth resonant portion being connected to the fifth resonant portion. The fourth resonant portion, the fifth resonant portion and the sixth resonant portion form a curved structure cooperatively, and the longitudinal direction of the sixth resonant portion is parallel to the longitudinal direction of the fourth resonant portion.

The fifth resonant portion is a right-angled triangle, and the fourth resonant portion and the sixth resonant portion are connected to a same right-angled side of the right-angled triangle, respectively, to form the curved structure.

The fifth resonant portion is a right-angled trapezoid or a rectangle, and the fourth resonant portion and the sixth resonant portion are connected to a same side of the right-angled trapezoid or the rectangle, respectively, to form the curved structure.

The first branch is a high frequency branch, the second branch and the public branch constitute a medium frequency branch cooperatively, and the third branch and the public branch constitute a low frequency branch cooperatively.

A resonant length of the high frequency branch is a sum of a long axis length and a short axis length of the elliptical ring; a resonant length of the medium frequency branch is a sum of a length of the first resonant portion, the length of the second resonant portion, the length of the third resonant portion and the length of the second branch; the resonant length of the low frequency branch is the sum of the length of the first resonant portion, the length of the second resonant portion, the length of the third resonant portion, the length of the fourth resonant portion, the length of the fifth resonant portion and the length of the sixth resonant portion; the resonant length of the high frequency branch is smaller than the resonant length of the medium frequency branch, and the resonant length of the medium frequency branch is smaller than the resonant length of the low frequency branch.

A coupling parameter of the high frequency branch and the medium frequency branch is a spacing between the first branch and the second resonant portion, and the coupling parameter of the medium frequency branch and the low frequency branch is the spacing between the second resonant portion and the fourth resonant portion.

Another technical scheme according to the present disclosure is to provide a terminal including: a shell and an antenna device.

The antenna device includes: a first branch, defined through the shell and configured as the earpiece metal mesh; a feed point, being inside the shell and electrically connected to the first branch; a second branch, a third branch and a public branch.

The second branch and the third branch are inside the shell and electrically connected to an end of the public branch. An another end of the public branch is electrically connected to the feed point.

The first branch, the second branch, the third branch and the public branch constitute the diversity antenna cooperatively.

The first branch has an elliptical ring configuration. A side of the first branch extends along a long axis direction of the elliptical ring to form a connecting portion connected to the feed point.

The diversity antenna is a monopole antenna and the diversity antenna resonates at a quarter wavelength.

The public branch includes a first resonant portion, a second resonant portion and a third resonant portion, the first resonant portion being connected to the feed point, the second resonant portion being connected to the first resonant portion, and the third resonant portion being connected to the second resonant portion and the second branch, respectively. A longitudinal direction of the first resonant portion is perpendicular to a long axis direction of the elliptical ring, the longitudinal direction of the second resonant portion is perpendicular to the longitudinal direction of the first resonant portion, and the longitudinal direction of the third resonant portion is perpendicular to the longitudinal direction of the second resonant portion.

The longitudinal direction of the second branch is perpendicular to the longitudinal direction of the third resonant portion.

The third branch may include a fourth resonant portion, a fifth resonant portion and a sixth resonant portion, the fourth resonant portion being formed by an extension of the second branch, the fifth resonant portion being connected to the fourth resonant portion, the sixth resonant portion being connected to the fifth resonant portion. The fourth resonant portion, the fifth resonant portion and the sixth resonant portion form a curved structure cooperatively, and the longitudinal direction of the sixth resonant portion is parallel to the longitudinal direction of the fourth resonant portion.

The fifth resonant portion is a right-angled triangle, and the fourth resonant portion and the sixth resonant portion are connected to a same right-angled side of the right-angled triangle, respectively, to form the curved structure.

Wherein the fifth resonant portion is a right-angled trapezoid or a rectangle, and the fourth resonant portion and the sixth resonant portion are connected to a same side of the right-angled trapezoid or the rectangle, respectively, to form the curved structure.

The first branch is a high frequency branch, the second branch and the public branch constitute a medium frequency branch cooperatively, and the third branch and the public branch constitute a low frequency branch cooperatively.

A resonant length of the high frequency branch is a sum of a long axis length and a short axis length of the elliptical ring; the resonant length of the medium frequency branch is the sum of the length of the first resonant portion, the length of the second resonant portion, the length of the third resonant portion and the length of the second branch; the resonant length of the low frequency branch is the sum of the length of the first resonant portion, the length of the second resonant portion, the length of the third resonant portion, the length of the fourth resonant portion, the length of the fifth resonant portion and the length of the sixth resonant portion; the resonant length of the high frequency branch is smaller than the resonant length of the medium frequency branch, and the resonant length of the medium frequency branch is smaller than the resonant length of the low frequency branch.

A coupling parameter of the high frequency branch and the medium frequency branch is a spacing between the first branch and the second resonant portion, and the coupling parameter of the medium frequency branch and the low frequency branch is the spacing between the second resonant portion and the fourth resonant portion.

BRIEF DESCRIPTION OF THE DRAWINGS

To further illustrate technical solutions of embodiments of the present disclosure, drawings needed for description of the embodiments will be briefly introduced. Obviously, the following drawings are only some embodiments of the present disclosure. To any one of skill in the art, other drawings may be obtained without any creative work based on the following drawings.

DETAILED DESCRIPTION

The technical scheme in the embodiments of the present disclosure will be clearly and completely described below referring to the accompanying drawings in the embodiments of the present disclosure. The embodiments described are only some embodiments of the present disclosure and not limited thereto. Based on the embodiments of the present disclosure, any embodiment obtained by those of ordinary skill in this field without performing creative labor, should be within the scope of the present disclosure.

Figure 1:
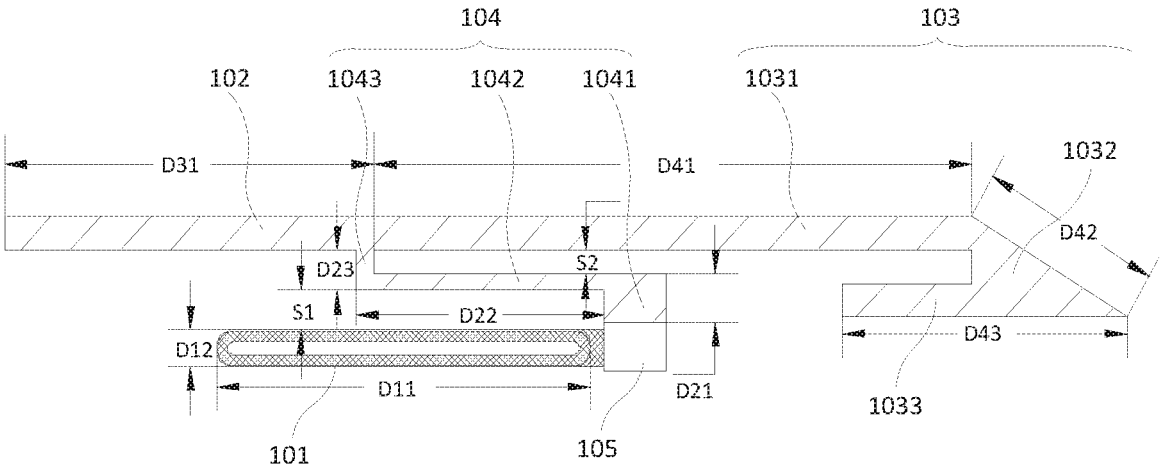
FIG. 1 is a structural schematic view of an antenna according to an embodiment of the present disclosure.

Referring to FIG. 1, an antenna device according to an embodiment of the present disclosure may include a first branch 101, a second branch 102, a third branch 103, a public branch 104, and a feed point 105, constituting a diversity antenna cooperatively. The first branch 101 is configured as an earpiece metal mesh. The feed point 105 is electrically connected to the first branch 101. The second branch 102, the third branch 103 are electrically connected to an end of the public branch 104. An another end of the public branch 104 is electrically connected to the feed point 105.

In the embodiment, the diversity antenna is a monopole antenna and the diversity antenna resonates at a quarter wavelength.

In the embodiment, the first branch 101, the second branch 102, the third branch 103, and the public branch 104 are all a metal mesh or a metal wire. The feed point 105 is a metal point, such as a metal mesh, a metal wire, or a metal point made of aluminum, copper, or silver.

Specifically, the first branch 101 has an elliptical configuration. A side of the first branch 101 may extends along a long axis direction of the elliptical ring to form a connecting portion connected to the feed point 105. The public branch 104 may include a first resonant portion 1041 connected to the feed point 105, a second resonant portion 1042, and a third resonant portion 1043 connected in sequence. The second branch 102 has a rectangular configuration and is connected to the third resonant portion 1043. The third branch 103 may include a fourth resonant portion 1031, a fifth resonant portion 1032 and a sixth resonant portion 1033 connected in sequence. The fourth resonant portion 1031 may be formed by an extension of the second branch 102. A longitudinal direction of the first resonant portion 1041 may be substantially perpendicular to a long axis direction of the elliptical ring. The longitudinal direction of the second resonant portion 1042 may be substantially perpendicular to the longitudinal direction of the first resonant portion 1041.

The longitudinal direction of the third resonant portion 1043 may be substantially perpendicular to the longitudinal direction of the second resonant portion 1042. The longitudinal direction of the second branch 102 may be substantially perpendicular to the longitudinal direction of the third resonant portion 1043. The fourth resonant portion 1031, the fifth resonant portion 1032, and the sixth resonant portion 1033 form a curved structure, and the longitudinal direction of the sixth resonant portion 1033 may be substantially parallel to the longitudinal direction of the fourth resonant portion 1031.

Specifically, the first branch 101 is a high frequency branch, the second branch 102 and the public branch form a medium frequency branch cooperatively, and the third branch 103 and the public branch 104 form a low frequency branch cooperatively. In the embodiment, the high frequency branch covers a high frequency $f_{high}$ of 2300-2700 MHz, the medium frequency branch covers a medium frequency $f_{middle}$ of 1700-2170 MHz, and the low frequency branch covers a low frequency $f_{low}$ of 700-960 MHz. A resonant length of the high frequency branch is a sum L1 of a long axis length D11 and a short axis length D12 of the elliptical ring, and the resonant length of the high frequency branch may be mathematical represented as $L1=C/(4*f_{high})$, where C is the speed of light and $f_{high}$ is the high frequency. The resonant length of the high frequency branch may be 27.78 to 32.61 mm, such as 27.78 mm, 30 mm or 32.61 mm. The resonant length of the medium frequency branch is the sum L2 of the length D21 of the first resonant portion 1041, the length D22 of the second resonant portion 1042, the length D23 of the third resonant portion 1043, and the length D31 of the second branch 102. The resonant length of the intermediate frequency branch may be mathematical represented as $L2=C/(4*f_{middle})$, where C is the speed of light and $f_{middle}$ is the medium frequency. The resonant length of the medium frequency branch may be 34.56 to 44.12 mm, such as 34.56 mm, 4 mm or 44.12 mm. The resonant length of the low frequency branch is the sum L3 of the length D21 of the first resonant division 1041, the length D22 of the second resonant division 1042, the length D23 of the third resonant division 1043, the length D41 of the fourth resonant division 1031, a length D42 of the fifth resonant division 1032, and the length D43 of the sixth resonant division 1033. The resonant length of the low frequency branch may be mathematical represented as $L3=C/(4*f_{low})$, where C is the speed of light and $f_{low}$ is the low frequency. The resonant length of the low frequency branch may be 78.13 to 107.14 mm, such as 78.13 mm, 90 mm, 100 mm, or 107.14 mm; the resonant length L1 of the high frequency branch is less than the resonant length L2 of the medium frequency branch, and the resonant length L2 of the medium frequency branch is less than the resonant length L3 of the low frequency branch. A width of the second branch 102, the width of the third branch 103, and the width of the public branch 104 are greater than or equal to 1 mm, such as 1 mm, 1.5 mm or 2 mm.

A coupling parameter of the high frequency branch and the medium frequency branch is a spacing S1 between the first branch 101 and the second resonant portion 1042, wherein the length of S1 is 0.5-3 mm, such as 0.5 mm, 1 mm, 2 mm or 3 mm. The coupling parameter of the medium frequency branch and the low frequency branch is the spacing S2 between the second resonant portion 1042 and the fourth resonant portion 1032, wherein the length of S2 is 0.5-3 mm, such as 0.5 mm, 1 mm, 2 mm, or 3 mm.

When the antenna device is applied to different terminals, the length of the first branch 101, the second branch 102, the third branch 103 and the public branch 104 may be adjusted such that a frequency coverage of the high frequency, the medium frequency and the low frequency may be controlled respectively. The spacing S1 of the first branch 101 and the second resonant portion 1042, and the spacing S2 of the second resonant portion 1042 and the fourth resonant portion 1032 may be adjusted such that the coupling of the high frequency and the medium frequency, and the coupling of the medium frequency and the low frequency may be controlled respectively.

In the embodiment, the fifth resonant portion 1032 may have a right-angled triangle configuration, and the fourth resonant portion 1031 and the sixth resonant portion 1033 are connected to a same right-angled side of the right-angled triangle respectively to form a curved structure. An angle of the right-angled triangle away from the fourth resonant portion 1031 and the sixth resonant portion 1033 is 45°.

Figure 2:
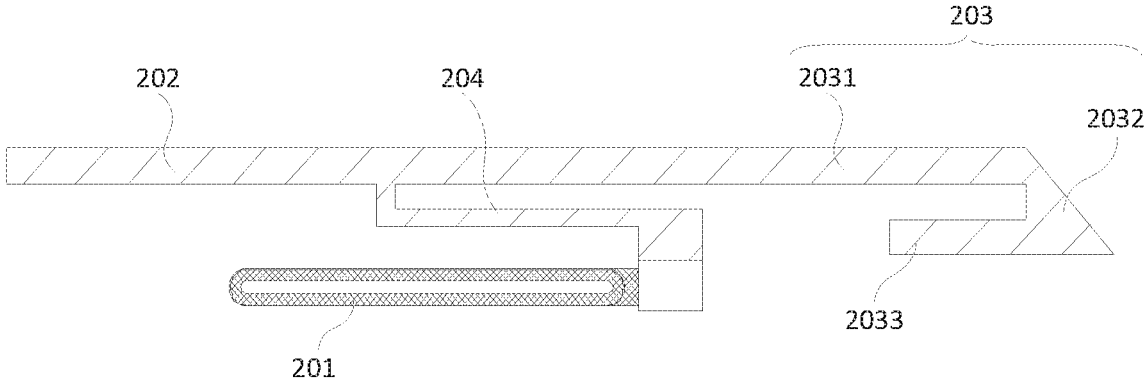
FIG. 2 is a structural schematic view of an antenna according to another embodiment of the present disclosure.

Referring to FIG. 2, an antenna device according to another embodiment may include a first branch 201, a second branch 202, a third branch 203, and a public branch 204. The third branch 203 may include a fourth resonant portion 2031, a fifth resonant portion 2032, and a sixth resonant portion 2033. The fifth resonant portion 2032 has a right-angled triangle configuration and the fourth resonant portion 2031 and the sixth resonant portion 2033 are connected to a same right-angled side of the right-angled triangle respectively to form a curved structure. An angle of the right angle triangle away from the fourth resonant portion 2031 and the sixth resonant portion 2033 is 45°-90°, such as 50°, 60°, 75° or 90°.

Figure 3:
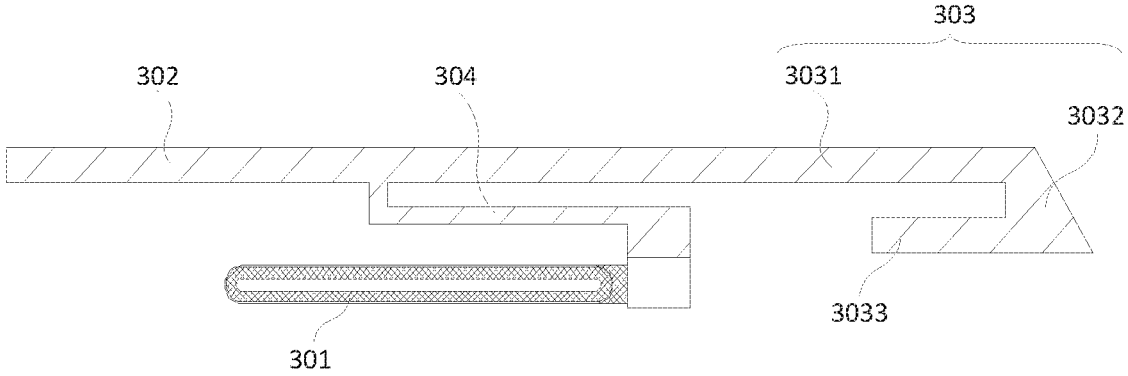
FIG. 3 is a structural schematic view of an antenna according to another embodiment of the present disclosure.

Referring to FIG. 3, an antenna device according to another embodiment may include a first branch 301, a second branch 302, a third branch 303, and a public branch 304, wherein the third branch 303 may include a fourth resonant portion 3031, a fifth resonant portion 3032, and a sixth resonant portion 3033. The fifth resonant portion 3032 has a right-angle trapezoid configuration. The fourth resonant portion 3031 and the sixth resonant portion 3033 are connected to a right-angle side of the right-angle trapezoid respectively to form a curved structure. An acute angle of the right-angled trapezoid away from the fourth resonant portion 3031 and the sixth resonant portion 3033 is 45°-90°, such as 45°, 60°, 75° or 90°.

Figure 4:
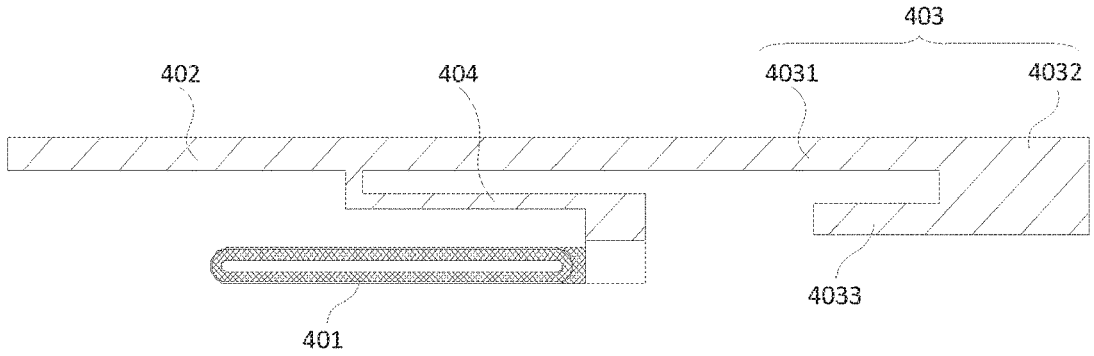
FIG. 4 is a structural schematic view of an antenna according to another embodiment of the present disclosure.

Referring to FIG. 4, an antenna device according to another embodiment may include a first branch 401, a second branch 402, a third branch 403, and a public branch 404, wherein the third branch 403 may include a fourth resonant portion 4031, a fifth resonant portion 4032, and a sixth resonant portion 4033. The fifth resonant portion 4032 has a rectangle configuration and the fourth resonant portion 4031 and the sixth resonant portion 403 are connected to a same side of the rectangle respectively to form a curved structure.

According to the embodiments of the present disclosure, a portion of the diversity antenna is configured as the earpiece metal mesh, that is, an integrated design of the diversity antenna and the earpiece metal mesh is achieved, thereby significantly reducing the impact of the earpiece metal mesh on the radiation performance of the antenna, and reducing a cost of research and development, and control and management.

Figure 5:
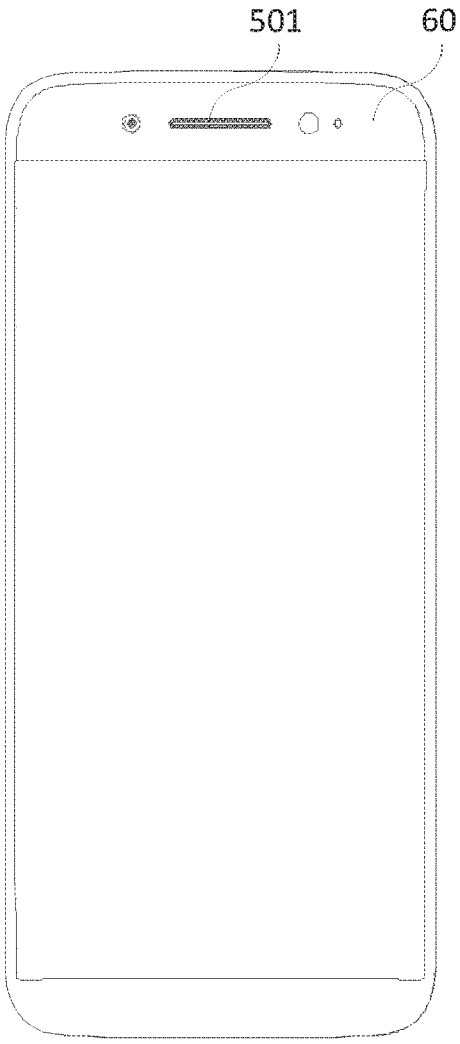
FIG. 5 is a front view of a terminal device according to an embodiment of the present disclosure.
Figure 6:
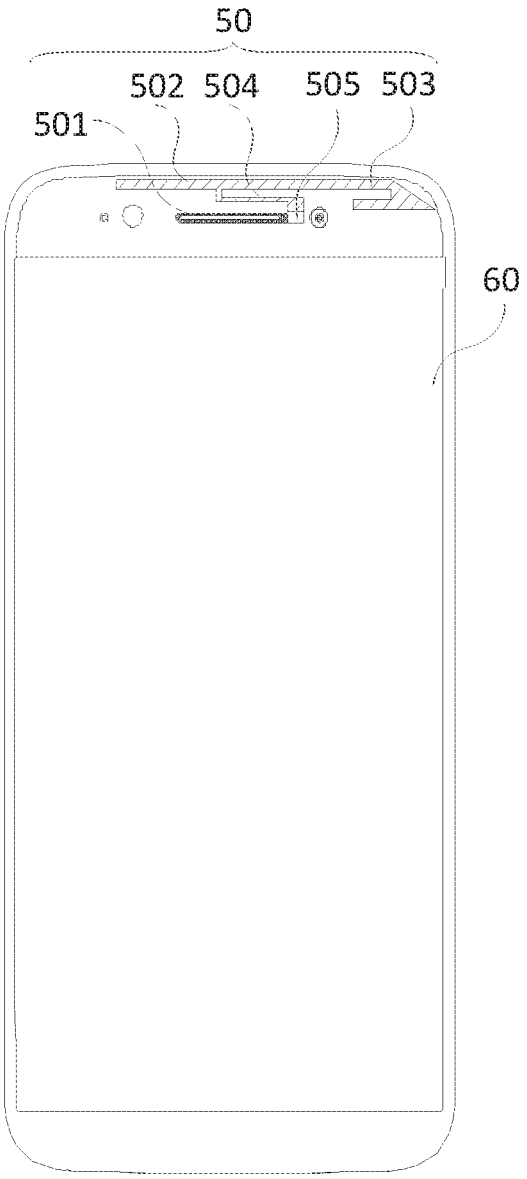
FIG. 6 is a structural schematic view of a rear side of a terminal device according to an embodiment of the present disclosure.

Referring to FIG. 5 and FIG. 6, a terminal according to an embodiment of the present disclosure may include an antenna device 50 and a shell 60. The antenna device 50 may include a first branch 501 defined through in the shell 60 and configured as the earpiece metal mesh; a feed point 50 electrically connected to the first branch 501 and located inside the shell 60; a second branch 502, a third branch 503 and a public branch 504 which are located inside the shell 60.

The second branch 502 and the third branch 503 are electrically connected to an end of the public branch 504 respectively. An another end of the public branch 504 is electrically connected to the feed point 505;

The first branch 501, the second branch 502, the third branch 503 and the public branch 504 constitute the diversity antenna cooperatively.

Specifically, the structure of the antenna device 50 is described in the antenna device according to the embodiments described as above, wherein the high frequency branch, medium frequency branch, or low frequency branch may be formed directly of the first branch 501, the second branch 502, the third branch 503 and the public branch 504, or may be formed of the first branch 501, the second branch 502, the third branch 503 and the public branch 504 connected to a component on a motherboard of the terminal.

According to the embodiments of the present disclosure, a portion of the diversity antenna is configured as the earpiece metal mesh, that is, an integrated design of the diversity antenna and the earpiece metal mesh is achieved, thereby significantly reducing the impact of the earpiece metal mesh on the radiation performance of the antenna, and reducing a cost of research and development, and control and management.

The above description is for the purpose of illustrating implementations of the present disclosure, but not to limit the scope of the present disclosure. Any equivalent structural or process transformation performed based on the drawings and the specification of the present disclosure, applied directly and indirectly in other related art, should be within the scope of the present disclosure.

What is claimed is:

1. An antenna device, comprising:

a first branch, serving as an earpiece metal mesh;

a feed point, electrically connected to the first branch;

a second branch, a third branch and a public branch, wherein:

the second branch and the third branch are electrically connected to an end of the public branch, and another end of the public branch is electrically connected to the feed point;

the feed point is connected between the first branch and the public branch;

the first branch, the second branch, the third branch and the public branch constitute a diversity antenna cooperatively;

wherein the earpiece metal mesh has an axis; a side of the first branch extends along a long axis direction of the earpiece metal mesh to form a connecting portion connected to the feed point;

the public branch comprises a first resonant portion, a second resonant portion and a third resonant portion, wherein the first resonant portion is connected to the feed point, the second resonant portion is connected to the first resonant portion, and the third resonant portion is connected to the second resonant portion and the second branch, respectively; a longitudinal direction of the first resonant portion is perpendicular to a long axis direction of the earpiece metal mesh; the longitudinal direction of the second resonant portion is perpendicular to the longitudinal direction of the first resonant portion; the longitudinal direction of the third resonant portion is perpendicular to the longitudinal direction of the second resonant portion.

2. The antenna device according to claim 1, wherein, the longitudinal direction of the second branch is perpendicular to the longitudinal direction of the third resonant portion.

3. The antenna device according to claim 2, wherein, the third branch comprises a fourth resonant portion, a fifth resonant portion and a sixth resonant portion, the fourth resonant portion being formed by an extension of the second branch, the fifth resonant portion being connected to the fourth resonant portion, the sixth resonant portion being connected to the fifth resonant portion; the fourth resonant portion, the fifth resonant portion and the sixth resonant portion form a curved structure, and the longitudinal direction of the sixth resonant portion is parallel to the longitudinal direction of the fourth resonant portion.

4. The antenna device according to claim 3, wherein, the fifth resonant portion has a right-angled triangle configuration; the fourth resonant portion and the sixth resonant portion are connected to a same right-angled side of the right-angled triangle, respectively, to form the curved structure.

5. The antenna device according to claim 3, wherein, the fifth resonant portion has a right-angled trapezoid configuration or a rectangle configuration; the fourth resonant portion and the sixth resonant portion are connected to a same side of the right-angled trapezoid or the rectangle, respectively, to form the curved structure.

6. The antenna device according to claim 3, wherein, the first branch is a high frequency branch; the second branch and the public branch constitute a medium frequency branch cooperatively; the third branch and the public branch constitute a low frequency branch cooperatively.

7. The antenna device according to claim 6, wherein, a resonant length of the high frequency branch is a sum of a long axis length and a short axis length of the earpiece metal mesh; the resonant length of the medium frequency branch is the sum of a length of the first resonant portion, the length of the second resonant portion, the length of the third resonant portion and the length of the second branch; the resonant length of the low frequency branch is the sum of the length of the first resonant portion, the length of the second resonant portion, the length of the third resonant portion, the length of the fourth resonant portion, the length of the fifth resonant portion, and the length of the sixth resonant portion; the resonant length of the high frequency branch is less than the resonant length of the medium frequency branch, and the resonant length of the medium frequency branch is less than the resonant length of the low frequency branch.

8. The antenna device according to claim 6, wherein, a coupling parameter of the high frequency branch and the medium frequency branch is a spacing between the first branch and the second resonant portion; the coupling parameter of the medium frequency branch and the low frequency branch is the spacing between the second resonant portion and the fourth resonant portion.

9. A terminal, comprising:

a shell, comprising an outer side defining a rectangular region; and an antenna device disposed in the rectangular region, the antenna device comprising:

a first branch, serving as an earpiece metal mesh;

a feed point, electrically connected to the first branch; and a second branch, a third branch and a public branch, wherein:

the second branch and the third branch are electrically connected to an end of the public branch, and another end of the public branch is electrically connected to the feed point;

the feed point is connected between the first branch and the public branch;

the first branch, the second branch, the third branch and the public branch constitute a diversity antenna cooperatively;

the first branch has an elliptical ring configuration;

a side of the first branch extends along a long axis direction of the earpiece metal mesh to form a connecting portion connected to the feed point; and the diversity antenna is a monopole antenna resonating at a quarter wavelength of a frequency band;

wherein the public branch comprises a first resonant portion, a second resonant portion and a third resonant portion, wherein the first resonant portion is connected to the feed point, the second resonant portion is connected to the first resonant portion, and the third resonant portion is connected to the second resonant portion and the second branch, respectively; a longitudinal direction of the first resonant portion is perpendicular to a long axis direction of the earpiece metal mesh; the longitudinal direction of the second resonant portion is perpendicular to the longitudinal direction of the first resonant portion; the longitudinal direction of the third resonant portion is perpendicular to the longitudinal direction of the second resonant portion.

10. The antenna device according to claim 9, wherein, the longitudinal direction of the second branch is perpendicular to the longitudinal direction of the third resonant portion.

11. The antenna device according to claim 10, wherein, the third branch comprises a fourth resonant portion, a fifth resonant portion and a sixth resonant portion, the fourth resonant portion being formed by an extension of the second branch, the fifth resonant portion being connected to the fourth resonant portion, the sixth resonant portion being connected to the fifth resonant portion; the fourth resonant portion, the fifth resonant portion and the sixth resonant portion form a curved structure, and the longitudinal direction of the sixth resonant portion is parallel to the longitudinal direction of the fourth resonant portion.

12. The antenna device according to claim 11, wherein, the fifth resonant portion has a right-angled triangle configuration; the fourth resonant portion and the sixth resonant portion are connected to a same right-angled side of the right-angled triangle, respectively, to form the curved structure.

13. The antenna device according to claim 11, wherein, the fifth resonant portion has a right-angled trapezoid configuration or a rectangle configuration; the fourth resonant portion and the sixth resonant portion are connected to a same side of the right-angled trapezoid or the rectangle, respectively, to form the curved structure.

14. The antenna device according to claim 11, wherein, the first branch is a high frequency branch, the second branch and the public branch constitute a medium frequency branch cooperatively, and the third branch and the public branch constitute a low frequency branch cooperatively.

15. The antenna device according to claim 14, wherein, the high frequency branch, the medium frequency branch, or the low frequency branch is formed directly of the first branch, the second branch, the third branch, and the public branch, or is formed of the first branch, the second branch, the third branch, and the public branch connected to a component on a motherboard of the terminal.

16. The antenna device according to claim 14, wherein, a resonant length of the high frequency branch is a sum of a long axis length and a short axis length of the earpiece metal mesh; the resonant length of the medium frequency branch is the sum of a length of the first resonant portion, the length of the second resonant portion, the length of the third resonant portion and the length of the second branch; the resonant length of the low frequency branch is the sum of the length of the first resonant portion, the length of the second resonant portion, the length of the third resonant portion, the length of the fourth resonant portion, the length of the fifth resonant portion, and the length of the sixth resonant portion; the resonant length of the high frequency branch is less than the resonant length of the medium frequency branch, and the resonant length of the medium frequency branch is less than the resonant length of the low frequency branch.

17. The antenna device according to claim 14, wherein, a coupling parameter of the high frequency branch and the medium frequency branch is a spacing between the first branch and the second resonant portion; the coupling parameter of the medium frequency branch and the low frequency branch is the spacing between the second resonant portion and the fourth resonant portion.

* * * * *